US009664099B2

(12) United States Patent
Chu

(10) Patent No.: US 9,664,099 B2
(45) Date of Patent: May 30, 2017

(54) APPARATUS FOR DISCHARGING EXHAUST GAS OF VEHICLE

(71) Applicant: Hyundai Motor Company, Seoul (KR)

(72) Inventor: Dong Ho Chu, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/740,998

(22) Filed: Jun. 16, 2015

(65) Prior Publication Data

US 2016/0160732 A1 Jun. 9, 2016

(30) Foreign Application Priority Data

Dec. 9, 2014 (KR) ..... 10-2014-0176004

(51) Int. Cl.
*F01N 1/00* (2006.01)
*F01N 13/10* (2010.01)

(52) U.S. Cl.
CPC ..... *F01N 13/105* (2013.01); *F01N 2240/20* (2013.01); *F01N 2260/10* (2013.01); *F01N 2260/18* (2013.01)

(58) Field of Classification Search
CPC ..... F01N 13/10; F01N 13/107; F01N 13/08; F01N 13/105; F01N 2240/20; F01N 2260/10; F01N 2260/18
USPC ..... 60/323, 324
See application file for complete search history.

(56) References Cited

U.S. PATENT DOCUMENTS 4,002,026 A * 1/1977 Loffelhardt ..... F01N 3/26 422/173
4,813,232 A * 3/1989 Hitomi ..... F01N 13/08 60/280
4,815,274 A * 3/1989 Piatti ..... F01N 13/08 60/313
6,256,990 B1 * 7/2001 Itoh ..... F01D 9/026 60/323
6,415,600 B1 * 7/2002 Lejon ..... F01N 3/20 60/280
6,557,343 B2 * 5/2003 Furudate ..... F01N 13/08 60/324
7,418,818 B2 * 9/2008 Kato ..... F01N 3/2803 60/313

FOREIGN PATENT DOCUMENTS

JP 60-95118 U 6/1985
JP 4-52419 Y2 12/1992
JP 6-74038 A 3/1994
JP 0674038 * 3/1994

(Continued)

*Primary Examiner* — Thai Ba Trieu
*Assistant Examiner* — Diem Tran
(74) *Attorney, Agent, or Firm* — Morgan Lewis & Bockius LLP

(57) ABSTRACT

An apparatus for discharging exhaust gas of a vehicle may include an exhaust port forming a first confluence part at which at least two runners among runners of an exhaust manifold connected with a cylinder are joined, and a second confluence part at which the remaining runners are joined, and a connector member having an inlet port through which exhaust gas discharged through the exhaust port is introduced, and having a partition which is formed toward the exhaust port in the inlet port so as to partition the first confluence part and the second confluence part.

4 Claims, 4 Drawing Sheets

(56) References Cited

FOREIGN PATENT DOCUMENTS

| | | | |
|---|---|---|---|
| KR | 10-2007-0112150 | A | 11/2007 |
| KR | 10-2008-0094379 | A | 10/2008 |
| KR | 10-2011-0062365 | A | 6/2011 |

* cited by examiner

APPARATUS FOR DISCHARGING EXHAUST GAS OF VEHICLE

CROSS-REFERENCE(S) TO RELATED APPLICATIONS

The present application claims priority of Korean Patent Application Number 10-2014-0176004 filed Dec. 9, 2014, the entire contents of which is incorporated herein for all purposes by this reference.

BACKGROUND OF THE INVENTION

Field of the Invention

Exemplary embodiments of the present invention relate to an exhaust manifold for a vehicle which can prevent a crack from occurring on an end portion of an exhaust port due to high-temperature gas discharged from the exhaust manifold.

Description of Related Art

Recently, in order to apply a downsizing concept of a gasoline turbocharger, the use of an exhaust manifold-integrated cylinder head has showed a tendency to gradually increase, and especially, the exhaust manifold-integrated cylinder head has been widely used to improve the fuel efficiency in a high-speed high-load range.

Since the aforementioned exhaust manifold-integrated cylinder head includes a cylinder head and an exhaust manifold which are integrated with each other, the temperature of cooling water increased by the exhaust manifold additionally increases the temperature of a combustion chamber, so that it is possible to use a smaller amount of fuel than in the prior art, thereby improving the fuel efficiency in a high-speed high-load range.

However, since such an exhaust manifold is integrated with a cylinder head, the length of a runner is short, and exhaust energy is lost due to exhaust interference, so that a low-to-medium-speed performance is deteriorated.

In order to partially solve such a problem, a four-cylinder system is configured in a 4-2 type exhaust structure such that, among first, second, third and fourth runners 101, 102, 103 and 104, respectively, the first and fourth runners 101 and 104 are connected to each other, while the second and third runners 102 and 103 are connected to each other, as shown in FIG. 1, so as to form two exhaust ports at an end portion of an exhaust manifold. Such a structure is configured to increase the lengths of the runners and to reduce exhaust interference.

FIG. 2 is a cross-sectional view illustrating an exhaust port portion shown in FIG. 1, wherein a partition portion 105 is formed in a portion at which the two exhaust ports meet each other.

However, when such a partition portion 105 is continuously exposed to high-temperature exhaust gas, a crack occurs from an end portion 105-1 due to a limit of the property value of the exhaust manifold integrated with the cylinder head 100 and made of aluminum.

In order to solve such a problem, it may be considered to form a water jacket 106 at a position near to the partition portion. However, such a configuration cannot be achieved in the conventional mold structure because it is impossible to connect the water jacket lengthwise, and a 4-2 type exhaust structure cannot be formed due to limits in structure and shape on manufacturing the exhaust port at a position near to the water jacket.

In addition, the partition may be formed to be thicker than that in the prior art so as to improve the durability of the partition. However, in this case, the cross section area of the exhaust port is reduced to increase an exhaust resistance.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an exhaust gas discharging apparatus for a vehicle for preventing a crack on a partition portion which occurs on an end portion of an exhaust port due to continuous exposure to high-temperature exhaust gas.

According to various aspects of the present invention, an apparatus for discharging exhaust gas of a vehicle may include an exhaust port forming a first confluence part at which at least two runners among runners of an exhaust manifold connected with a cylinder are joined, and a second confluence part at which the remaining runners are joined, and a connector member having an inlet port through which exhaust gas discharged through the exhaust port is introduced, and having a partition which is formed toward the exhaust port in the inlet port so as to partition the first confluence part and the second confluence part.

A final boundary surface may be configured between the first confluence part and the second confluence part, and a gap may be disposed between the final boundary surface and an end portion of the partition which faces the final boundary surface.

A groove having a width greater than a thickness of the partition may be disposed at an intermediate portion of the final boundary surface so as to form the gap.

Both side surfaces continued from a bottom surface of the groove may be configured to have a shape which is expansively open while getting wider toward an outside from the bottom surface.

Water jackets may be formed at a lower portion adjacent to the first confluence part and an upper portion adjacent to the second confluence part.

The exhaust manifold may be configured to be integrated with a cylinder head.

The connector member may be configured to be integrated with a turbocharger.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In accordance with various embodiments of the present invention, an apparatus for discharging exhaust gas of a vehicle includes an exhaust port 11 formed on an exhaust manifold, and a connector member having a partition 23.

Figure 1:
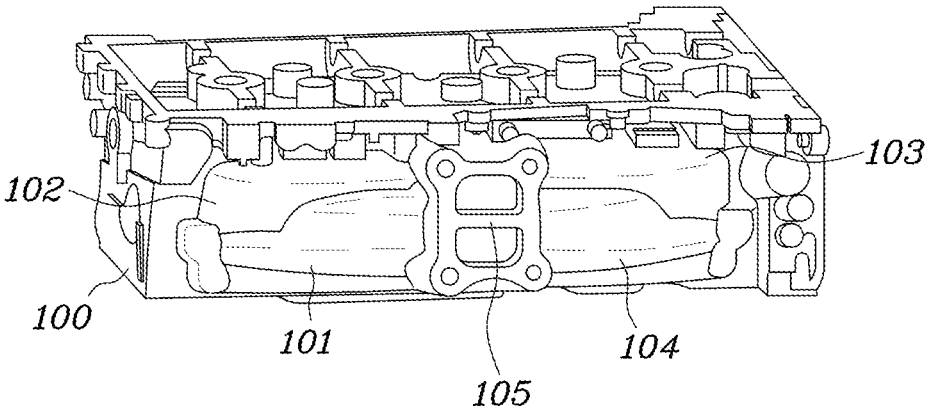
FIG. 1 Related Art
FIG. 1 is a view illustrating an exhaust manifold-integrated cylinder head.
Figure 2:
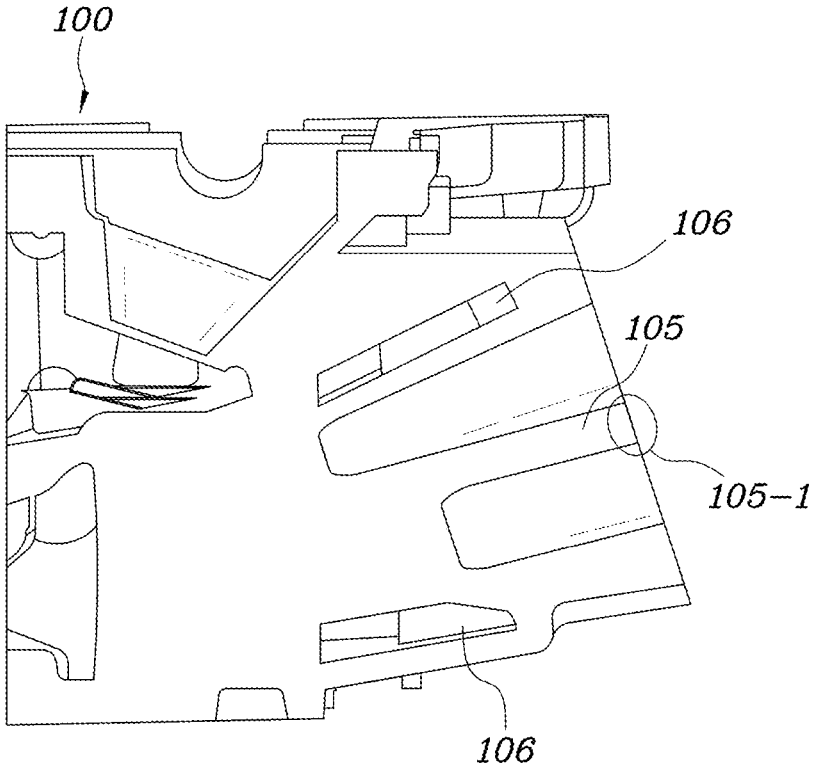
FIG. 2 Related Art
FIG. 2 is a cross-sectional view illustrating an exhaust port portion shown in FIG. 1.
Figure 3:
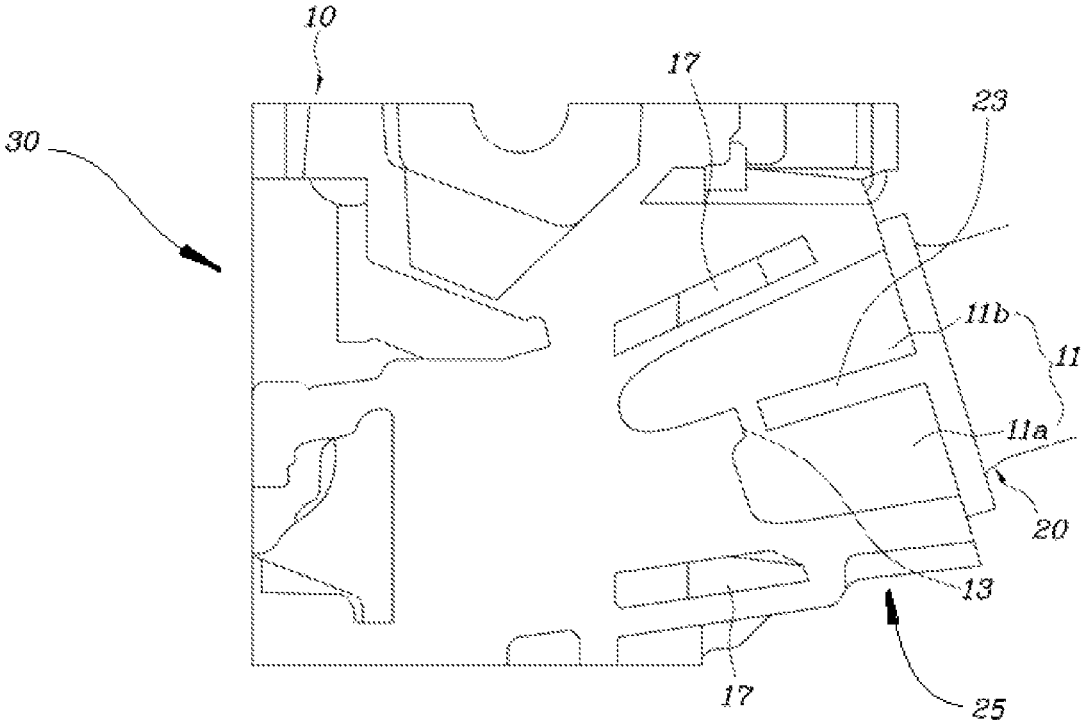
FIG. 3 is a cross-sectional view illustrating a structure in which a partition is disposed in an exhaust port according to an exemplary embodiment of the present invention.
Figure 4:
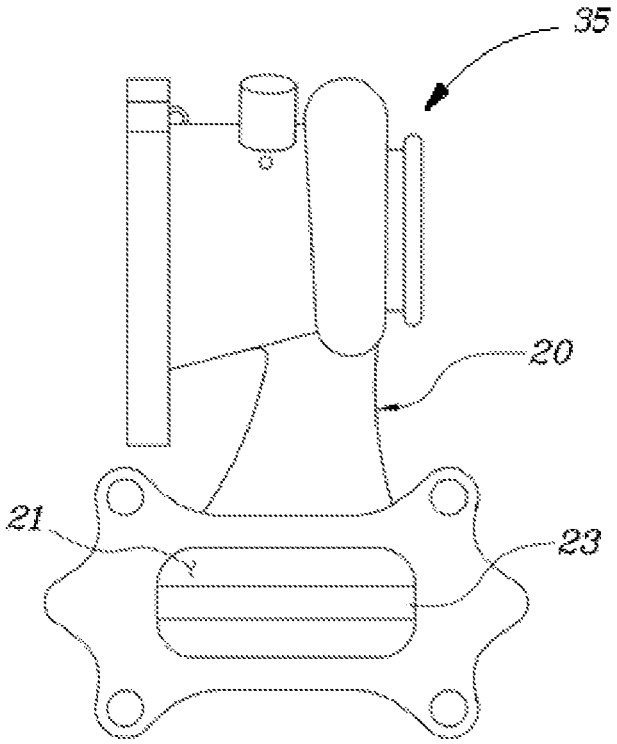
FIG. 4 is a view illustrating a structure of a turbine housing having a partition according to an exemplary embodiment of the present invention.

Describing the present invention in detail with reference to FIG. 3 and FIG. 4, first, the exhaust port 11 includes a first confluence part 11*a* at which at least two runners among runners of an exhaust manifold 25 connected with a cylinder 30 are joined, and a second confluence part 11*b* at which the remaining runners are joined.

Here, in accordance with various embodiments of the present invention, the exhaust manifold 25 may be configured to be integrated with a cylinder head 10. In the case of a four-cylinder engine, first, second, third and fourth runners of an exhaust manifold may be configured such that the first and fourth runners are joined to form the first confluence part 11*a* and the second and third runners are joined to form the second confluence part 11*b*. Accordingly, the exhaust port 11 is formed at an end portion of the runners, i.e. at a portion where the first confluence part 11*a* and the second confluence part 11*b* are met, so that a 4-2 type exhaust structure can be implemented through the partition 23 to be described later.

Especially, in accordance with various embodiments of the present invention, the connector member may be integrated with a turbocharger. In this case, the connector member will be a turbine housing (hereinafter, referred to as a "turbine housing").

That is to say, the turbine housing 20 is configured to have a shape surrounding the turbine of the turbocharger 35, and to have an inlet port 21 at an end portion thereof so as to provide the turbine with rotary power by exhaust gas, where the inlet port 21 is connected to the exhaust port 11, so that exhaust gas discharged through the exhaust port 11 is introduced into the turbine housing 20 through the inlet port 21.

In addition, the partition 23 is formed to be protruded toward the exhaust port 11 in the inlet port 21 so that the partition 23 can be disposed to partition the first confluence part 11*a* and the second confluence part 11*b*. In this case, the partition 23 may be formed to be integrated with the turbine housing 20 in the inlet port 21.

According to such a configuration, the partition 23 is integrated with the turbine housing 20 and extends to the inside of the exhaust port 11, so that the end portion of the partition 23 is formed not to be cut off, but to be connected to the inside of the inlet port 21, thereby enhancing the durability of the end portion of the partition than that in the prior art, and thus basically intercepting the cause of a crack.

Figure 5:
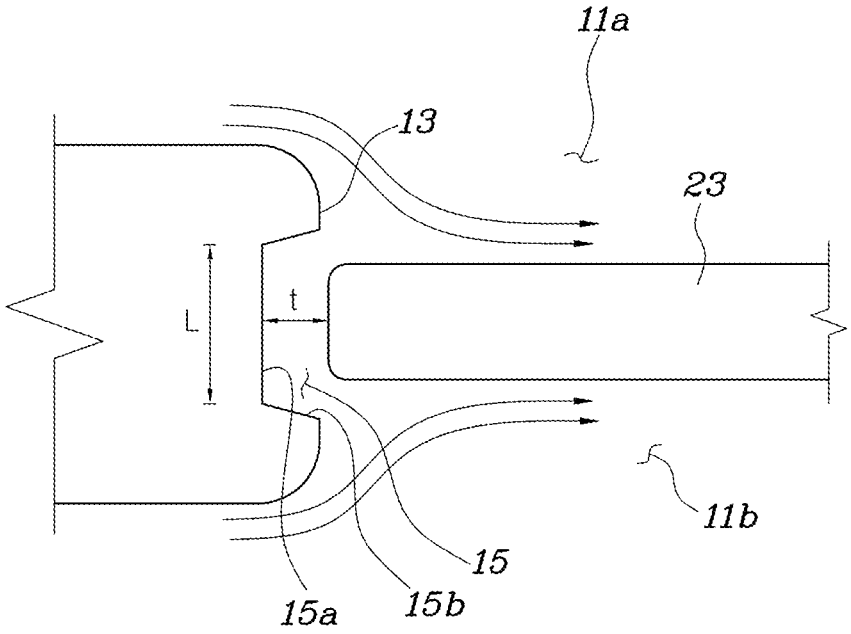
FIG. 5 is a view explaining the shape of a gap formed between an exhaust manifold and a partition according to an exemplary embodiment of the present invention.

Referring to FIG. 5, in accordance with various embodiments of the present invention, a gap "t" may be formed between a final boundary surface 13, which is formed between the first confluence part 11*a* and the second confluence part 11*b*, and the end portion of the partition 23, which faces the final boundary surface 13.

That is to say, when the partition 23 and exhaust manifold 25 are thermal-expanded by exhaust gas, an interference therebetween does not occur due to the gap "t".

In addition, a groove 15 having a width L greater than the thickness of the partition 23 may be formed at the intermediate portion of the final boundary surface 13 so as to form a gap "t" between the final boundary surface 13 and the end portion of the partition 23.

For example, both side surfaces 15*b* continued from the bottom surface 15*a* of the groove 15 may be formed to have a shape that is expansively open while getting wider toward the outside from the bottom surface 15*a*.

That is to say, by the gap "t" formed through the concavely-shaped groove 15 at the final boundary surface 13, exhaust interference is maximally prevented while mutual contact between exhaust gas discharged through the first confluence part 11*a* and second confluence part 11*b* is minimized, so that the exhaust gas is smoothly discharged through each exhaust port 11. Thus, the travel performance of a vehicle in a low-to-medium-speed range can be improved.

In addition, since the end portion of the partition 23 is formed not to be cut off, but to be connected to the inside of the inlet port 21, as described above, a feature of being robust to gas leakage is provided to have a superior characteristic in view of the entire sealing, even without employing a sealing member, such as a gasket, which has been applied to the end portion of a partition in the prior art.

In addition, the high-temperature durability can be improved, even without a separate water jacket formed to be adjacent to the partition 23, and the length of the runners become long because the 4-2 type exhaust structure is not changed, so that exhaust interference can be maximally prevented to improve the performance in a low-speed range.

Otherwise, water jackets 17 may be formed at a lower portion adjacent to the first confluence part 11*a* and an upper portion adjacent to the second confluence part 11*b*, respectively, in the cylinder head 10, thereby contributing improvement of high-temperature durability.

In addition, differently from the prior art in which a partition made of aluminum must be formed to have a thickness of about 12 mm, the present invention enables the partition 23 to have a thickness reduced to a degree of 4-5 mm due to the material characteristic of the turbine housing 20 which has a high-temperature durability, so that the exhaust resistance is largely reduced through an increase in the cross-section area of the exhaust port 11, thereby further improving the traveling performance.

In accordance with the exemplary embodiments of the present invention, the durability of the partition portion is ensured in an exhaust manifold-integrated cylinder head structure, so that occurrence of a crack on the partition portion can be prevented. In addition, since the thickness of the partition portion is minimized, the exhaust resistance is reduced through an increase in the cross-section area of the exhaust port, thereby improving the traveling performance of the vehicle at the low-to-medium-speed.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for discharging exhaust gas of a vehicle, the apparatus comprising:

an exhaust port forming a first confluence part at which at least two runners among runners of an exhaust manifold connected with a cylinder are joined, and a second confluence part at which remaining runners are joined; and a connector member having an inlet port through which exhaust gas discharged through the exhaust port is introduced, and having a partition formed to be protruded from an end portion of the connector toward the exhaust port to partition the first confluence part and the second confluence part, wherein a final boundary surface is positioned between the first confluence part and the second confluence part, and a gap is disposed between the final boundary surface and an end portion of the partition facing the final boundary surface, and wherein a groove having a width greater than a thickness of the partition is disposed at an intermediate portion of the final boundary surface to form the gap.

2. The apparatus of claim 1, wherein both side surfaces continued from a bottom surface of the groove are configured to have a shape expansively opening while getting wider toward an outside from the bottom surface.

3. The apparatus of claim 1, wherein water jackets are formed at a lower portion adjacent to the first confluence part and an upper portion adjacent to the second confluence part.

4. The apparatus of claim 1, wherein the exhaust manifold is configured to be integrated with a cylinder head.

* * * * *